United States Patent [19]

Galitello, Jr.

[11] Patent Number: 4,876,991

[45] Date of Patent: Oct. 31, 1989

[54] TWO STROKE CYCLE ENGINE

[76] Inventor: Kenneth A. Galitello, Jr., P.O. Box 25, Torrington, Conn. 06790

[21] Appl. No.: 281,530

[22] Filed: Dec. 8, 1988

[51] Int. Cl.[4] ..... F02B 71/00

[52] U.S. Cl. ..... 123/46 E

[58] Field of Search ..... 123/46 R, 46 E; 417/364

[56] References Cited

U.S. PATENT DOCUMENTS

| | | | |
|---|---|---|---|
| 2,091,547 | 8/1937 | Jalbert | 123/195 R |
| 2,814,551 | 11/1957 | Broeze et al. | 123/46 R |
| 2,944,535 | 7/1960 | Fikse | 123/46 R |
| 3,214,085 | 10/1965 | Boldt | 123/46 R |
| 3,370,576 | 2/1968 | Huber | 123/46 R |
| 3,643,638 | 2/1972 | Braun | 123/46 R |
| 3,675,031 | 7/1972 | Lavigne | 123/46 E |
| 3,986,796 | 10/1976 | Moiroux et al. | 123/46 R |
| 4,112,683 | 9/1978 | Bess | 123/46 R |
| 4,308,720 | 1/1982 | Brandstadter | 123/46 R |
| 4,362,477 | 12/1982 | Patten | 417/364 |
| 4,450,685 | 5/1984 | Corey | 60/517 |
| 4,462,345 | 7/1984 | Routery | 123/46 E |
| 4,480,599 | 11/1984 | Allais | 123/46 R |
| 4,532,431 | 7/1985 | Iliev et al. | 123/46 R |
| 4,776,166 | 10/1988 | Dixon | 123/46 R |

FOREIGN PATENT DOCUMENTS 2755434 6/1979 Fed. Rep. of Germany .... 123/46 E

*Primary Examiner*—David A. Okonsky
*Attorney, Agent, or Firm*—Richard A. Craig

[57] ABSTRACT

A free-piston two stroke cycle engine includes a piston rod assembly having a connecting rod with first and second ends, first and second power pistons affixed to the ends of the rod and first and second power transfer pistons mounted on the rod between the power pistons at locations spaced from each other, first and second power cylinders with sealed cavities in which the power pistons are movable. The cavities and the power pistons provide precompression chambers and combustion chambers of varying volumes. A timing module is located between the power cylinders, and first and second power transfer modules, each including a power transfer cylinder are between the timing module and the first and second power pistons, respectively. The connecting rod passes through the timing module and the power transfer modules and the first and second power transfer pistons reciprocate within the power transfer cylinders. The engine also includes gating and valving devices as appropriate, as well as a computer for controlling various aspects of the operation of the engine.

25 Claims, 6 Drawing Sheets

TWO STROKE CYCLE ENGINE

BACKGROUND OF THE INVENTION

This invention relates to a two stroke cycle engine and more particularly to a symmetrically designed free-piston two stroke cycle engine.

The invention can be viewed as presenting a free-piston two stroke cycle engine which is an improvement in several ways over the engines of the following U.S. Patents:

| U.S. Pat. No. | Date | Inventor(s) |
|---|---|---|
| 2,963,008 | December 6, 1960 | Waldrop |
| 3,089,305 | May 14, 1963 | Hobbs |
| 3,159,149 | December 1, 1964 | King et al. |
| 4,013,048 | March 22, 1977 | Reitz |
| 4,128,083 | December 5, 1978 | Bock |
| 4,185,597 | January 29, 1980 | Cinquegrani |
| 4,242,993 | January 6, 1981 | Onishi |
| 4,326,380 | April 27, 1982 | Rittmaster et al. |
| 4,369,021 | January 18, 1983 | Heintz |
| 4,516,540 | May 14, 1985 | Nerstrom |

Waldrop '008

Waldrop discloses a free-piston engine 10 including a free piston section 12 and a turbine 14. Free-piston section 12 has an upstanding casing 16 with flat parallel end walls 18 and 20. A first cylinder 22 has an open end 24 and a closed end 26, open end 24 abutting and fixedly secured to end wall 18 of casing 16 with closed end 26 remote from end wall 18. A second cylinder 32 is in alignment with cylinder 22 and has an open end 34 and a closed end 36, open end 34 abutting and fixedly secured to end wall 20 of casing 26.

First and second housings 42 and 52 have open ends 44 and 54, respectively, and contain cylinders 22 and 32, respectively, and have open ends 44 and 54, also respectively, which are secured to end walls 18 and 20, also respectively.

A first piston 72 is in cylinder 22 and a second piston 74 is in cylinder 32, and a piston rod 62, which has one end secured to piston 72 and the other end secured to piston 74, extends through casing 16. A third piston 76 is mounted on piston rod 62 within casing 16 half way between pistons 72 and 74. Thus, pistons 72, 74 and 76 and piston rod 62 reciprocate back and forth as a unit between a first position, as shown in FIG. 1, in which piston 72 is maximally spaced from wall 18 of casing 16, piston 74 is minimally spaced from end wall 20 of casing 16 and piston 76 is minimally spaced from end wall 18 of casing 16, and a second position in which piston 72 is minimally spaced from end wall 18 of casing 16, piston 74 is maximally spaced from end wall 20 of casing 16 and piston 76 is maximally spaced from end wall 18 of casing 16.

Casing end wall 18 has an ingress opening 82 for admitting air from the atmosphere into casing 16 between end wall 18 and piston 76. A check valve 84 within opening 82 permits air to enter casing 16 between end wall 18 and piston 76, but prevents air from venting to the atmosphere through opening 82. Casing end wall 18 also has an egress opening 86 connecting the space between piston 76 and end wall 18 with a chamber 88 between housing 42 and cylinder 22. A check valve 90 in opening 86 permits movement of air from casing 16 into chamber 88 when piston 76 moves toward end wall 18.

Casing end wall 20 is similarly provided with an ingress opening 92 and an egress opening 94, each with a check valve permitting atmospheric air to enter casing 16 between end wall 20 and piston 76 and to pass therefrom into a compression chamber 96 between cylinder 32 and housing 52.

Means in the form of a pump cylinder 98 is provided for injecting a charge of combustible fuel into each cylinder 22 and 32, and an actuating rod 106 extends through end wall 56 of housing 52 and through casing end wall 20 for sliding movement therein. One end of rod 106 bears against a rocker arm 102 and the other end is in casing 16 and positioned to be struck by piston 76 as the latter moves into abutting relation with respect to casing end wall 20 as a result of explosion of fuel in cylinder 22 between piston 32 and end wall 26 of cylinder 22. This causes rod 106 to actuate its associated rocker arm 102, thus to open its associated pump cylinder 98 to inject a fuel charge into cylinder 32. The other rod 106 (in housing 42) is struck by piston 76 when it is forced to its position adjacent end wall 18 by explosion of fuel in cylinder 32. This effects injection of fuel into cylinder 22. A rotor 118 in a turbine casing 116 is driven by exhaust gases from cylinders 22 and 32.

Cylinders 22 and 32 are provided with a plurality of inlet ports 122 and exhaust ports 124, the latter communicating with the interior of conduits 112. Ports 122 and 124 are covered by the skirts of pistons 72 and 74 when the latter are in their positions adjacent the closed ends of their respective cylinders.

In operation, suitable means initiates travel of piston 72 from its position shown in FIG. 1 adjacent cylinder end wall 26. As piston 76 moves toward casing end wall 20, atmospheric air is drawn in through ingress opening 82 and air is forced through egress opening 94 into compression chamber 96. Cylinders 22 and 32 are provided with ports 132 inwardly of their open ends and as piston 74 moves toward cylinder closed end 36, part of the air compressed in chamber 96 flows through ports 132 into the space between piston 74 and casing end wall 20. Another part of the air compressed in chamber 96 enters inlet ports 122 and is compressed in cylinder 32 by piston 74 as it travels toward cylinder end wall 36. Next, piston 76 strikes actuating rod 106 which is associated with housing 52, causing injection of a charge of fuel into the compressed air in cylinder 32 where it explodes and drives piston 74 in the opposite direction to compress the air in cylinder 22 between piston 72 and end wall 26. Air is then drawn into casing 16 through opening 92 at the same time air is forced through opening 86 into compression chamber 88. As each piston 72 and 74 in turn uncovers its exhaust ports 124 part of the compressed air in the associated compression chamber flows through inlet ports 122 and scavenges combustion gases in the respective cylinders and flows through conduit 112 to drive turbine rotor 118 from which power may be taken for driving machinery. Successive injection of fuel into cylinders 22 and 32 will keep rotor 118 rotating.

Hobbs '305

Hobbs teaches an internal combustion engine and power transmission apparatus. Engine pistons are in cylinders and at least one piston and its cylinder serve as a hydraulic pump. The pistons are connected together whereby the engine is a free-piston engine. A movable part is associated with the pump piston so that pressure developed by forces from the engine pistons act on the movable part, which is caused to be displaced an amount dependent on the speed of the pistons and/or the load, whereby pressure and delivery of the pump vary automatically. The pump piston and/or the movable part can be varied at will. The displacement of the movable part may be varied by reason of its mass, or the mounting of the movable part may be made resilient, so that more or less force will produce more or less displacement. The hydraulic pressure may actuate a hydraulic motor.

King et al. '149

This patent relates to a free-piston engine, and more particularly to an air supply and control system for a free-piston engine. Still more particularly, it relates to an air pressurization and porting construction for supplying scavenge air, air pressure for fuel injection and air pressure for piston stroke control. The King et al. apparatus includes a porting system in combination with a free-piston engine, wherein the piston pressurizes air and opens and closes the ports to provide pressurized air for controlling the length of piston stroke, fuel injection, scavenge air and combustion air.

More particularly, air pressure within a specially constructed counter chamber 63 provides pressure to liquid fuel via a membrane, and in causing pressure on the fuel pushes it past a check valve, and on into the combustion chamber.

Counter chamber 63 is below the piston and above a bounce chamber 61. It receives air from the air box 25, compresses that air slightly into the conduit 87, and actuator chamber 83, thereby causing a pressure on a diaphram 81 which is flexed to produce an increase in pressure on the fuel within a pump chamber 85. This pressure on the fuel causes it to be forced by a dispersion or check valve 31 into the combustion chamber.

The King et al. engine uses "air only" in all areas except pump chamber 85 in which there exists liquid fuel. The fuel within chamber 85 is drawn in by a vacuum created by counter chamber 63 which acts upon diaphragm 81 and a check valve 89 prevents backflow. Fuel cannot be forced into chamber 63 under pressure, because that pressure will cause a fuel flow by the dispersion valve 31 and into the combustion chamber.

The King et al. design is an air supply and control system the purpose of which is to provide, all in one cylinder, air to a bounce chamber thereby limiting piston travel, air to be pressurized by the counter chamber, to cause pressure on the fuel, thereby forcing fuel into the combustion chamber, and air to scavenge the combustion chamber.

Bock '083

Bock discloses a gas cushioned free-piston engine comprising two oppositely arranged combustion cylinders and a pair of pistons reciprocally mounted therein. The pistons are rigidly connected to each other by a common piston rod. The engine further includes a pump cylinder located between the two combustion chambers, a pump piston having opposite faces on which fluid impinges. The pump piston is fixed to the piston rod and divides the pump cylinder into a pair of chambers, one of which is a common suction chamber and the other of which is a commmon pressure chamber, which together with inlet valves and outlet valves, are in the central part of the engine.

Reitz '048

Reitz presents an improved "Bourke" type engine, certain features of which are disclosed in Bourke U.S. Pat. Nos. 2,122,676, 2,122,677 and 2,172,670. The Bourke engine is more fully described in a publication entitled "Bourke Engine Documentary" by Lois Bourke, copyrighted by the author in 1968, and printed by D. D. Enterprises of North Hollywood, Calif. 91601. In the Bourke type engine at least two cylinders are oppositely disposed so that the free ends of a piston rod extending from pistons reciprocable in the cylinders are connected by a yoke and the pistons reciprocate as a unit. The yoke has means rotatably engaging a rotating crank by which force developed by reciprocation of the pistons is converted to rotating driving motion. In Reitz's improvements, the inner end of the piston rod is placed in abutment with the underside of the piston head and the yoke is modified to house a block slider instead of a rolling bearing to provide better bearing surfaces and lubrication thereof.

Cinquegrani '597

Cinquegrani relates to a self-charging dual piston engine apparatus which has a plurality of intake ports having reed type check valves.

Rittmaster et al. '380

Rittmaster et al. discloses an engine for operating a hydraulic motor. Opposed pistons, joined by a common connecting rod, operate between two cylinders and between internal valving and ignition components, which are used to drive fluid under pressure through a series of cross-over valves to and from the hydraulic motor. Hydraulic fluid is stored and maintained under pressure within the engine cylinder on the other side of the pistons forming an internal combustion engine. A series of inserts in the connecting rod actuate a matched set of proximity detectors which, in turn, time the operation of the engine and the cross-over valves without mechanical linkages. A hydraulic pump starts the engine, and a blower mixes fuel and air in the engine and is also used to exhaust combustion gases. The hydraulic motor drives a flywheel to store energy and dampen pulsations resulting from shifting of the cross-over valves and the reciprocating action of the pistons.

Onishi '993 This is not a free-piston engine, but is a 2-cycle engine with a piston 4, a crank room 8, a balance weight 9 in crank room 8 and a connecting rod 10 connected between piston 4 and balance weight 9. A transfer passage 19 communicates crank room 8 with a combustion chamber 6, and an accumulation tank 17 having a volume which is larger than the stroke volume of piston 4 is arranged in transfer passage 19. A reed valve is located in transfer passage 19 between crank room 8 and accumulation tank 17.

Heintz '021

Heintz discloses a free-piston engine pump system. The system operates in response to internal combustion for pressurizing a working fluid to provide hydraulic power output. The pump has double acting power pistons and pumping pistons fixedly attached as a main reciprocating member and movable relative to a housing which itself is relatively movable for purposes of balancing mass. Air is supplied and exhaust products are exhausted from a pair of opposite combustion chambers by common intake and common exhaust valves that are operated by a common actuator in response to the position of the main reciprocating member in the housing and/or fluid pressure in the pumping chambers. A pressure responsive cycling valve controls the operation of the pump to initiate start-up, and a cooling air control valve controls delivery of cooling air to the exhaust valves and passages during the exhaust cycle.

Nerstrom '540

This is not a free-piston engine but is a 2-cycle engine 14 including an engine block 15 defining a cylinder 16 with a combustion chamber 17 and a cylinder head 18, with a spark plug 20. A crankcase 22 extends from combustion chamber 16, and a piston 24 has reciprocating movement in cylinder 16 and is connected via a connecting rod 27 to a crankshaft 22 extending through crankcase 22. A passage 3 is in engine block 15 and is an exhaust passage, a transfer passage, or a crankcase fuel intake passage, terminates at the cylinder wall in a port 32, such as an exhaust port, a transfer port or a piston-controlled, crankcase fuel intake port, having upper and lower edges 34 and 35 at predetermined distances from cylinder head end 36. A charge of fuel-air mixture, flowing through passage 30, is introduced into combustion chamber 17 as the upper edge 25 of piston 24 uncovers port 32 during travel from top dead center toward bottom dead center.

An exhaust passage 38 terminates at the cylinder wall in an exhaust port 40 having upper and lower edges located at predetermined distances from cylinder head end 36. Combustion products are exhausted from combustion chamber 17 through exhaust passage 38 as upper edge 25 of piston 24 uncovers exhaust port 40 during travel from top dead center toward bottom dead center.

A valve member 50 is movably mounted in exhaust passage 38 and is so arranged that when it so moves, it will vary the effective distance of an upper edge 42 of exhaust port 40 from cylinder head end 36 and thereby vary the timing of the opening of exhaust port 40, to suit varying operating conditions.

Since the oil shortage in the early 1970's, we have been searching for and developing our alternative energy capability. Much progress has been made in the areas of solar, wind, hydroelectric, fusion and other fields, but progress in the area of portable power sources for use in transportation (autos, trucks, aircraft, boats, motorcycles, etc.) has been slow.

Within the aforementioned modes of transportation, the basic designs are no different than over 100 years ago. In the mid to late 1800's the Otto cycle, and Diesel cycle engines were developed, and were found to provide a means to power the "horseless carriage". Over the years engineers have been working on and refining these engines to the point where they are now approaching a dead end.

Engineers and researchers have been turning lately to the two stroke cycle engine as a viable alternative. It provides simple design, light weight, fewer parts and more power output per displacement. The two stroke approach used to be regarded as a loud, polluting engine which emitted a blueish smoke when run because oil and gas had to be mixed together to provide lubrication for the engine. All that has changed since the introduction of new injectors for the two stroke engine which eliminates the need for mixing oil and gas, and hence the polluting smoke it emits has ceased.

For the past 100 or so years, engineers have been using the same basic mechanical movement within the internal combustion engine, an arrangement wherein the piston, connecting rod and crankshaft are coupled together to transfer the energy generated from combustion into usable work.

Not only is the basic mechanical movement wasteful, as it literally works against itself, but the whole process of combustion within these engines is wrong. In all combustion engines of today, Otto cycle, Diesel cycle, and two stroke cycle, a steady uniform flame front is desired. This is used to progressively burn the fuel mixture within the combustion chamber, and generate a growing pressure which drives the piston downward with maximum force after the piston has reached top dead center.

Spontaneous combustion is to be avoided at all costs within these engines, except for the Diesel. Spontaneous combustion or preignition of the fuel occurs prior to spark ignition and causes high pressures within the combustion chamber before the piston reaches top dead center, and in effect acts to slow down the engine and cause it to work against itself. In the case of the Diesel engine, fuel is injected as the piston reaches top dead center and continues piston travels toward bottom dead center. This also is wrong and wasteful, for as the piston is moving downward the gases are allowed to expand, and the last traces of fuel do not burn because the heat energy caused by compression within a Diesel is gone, and fuel being injected at the end of the injection cycle is introduced into a combustion chamber of mostly burnt gases. This is why Diesel powered trucks and autos emit the unburned hydrocarbons they do.

What is needed to cure the problems of internal combustion, is a fast burning engine, whereby the fuel mixture is brought to maximum temperature and pressure within a very short period of time, allowed to spontaneously combust, and impart its energy to a projectile such as a piston. This fast burning spontaneously combusting phenomenon is called detonation. With detonation, heat is not allowed to flow into the engine, as heat flow requires time. Instantly after detonation, the energy from the fuel is imparted to the piston, driving the piston downward with a tremendous speed and force. Instantly gases are expanded which in turn creates cooling of such gases.

A new mechanical arrangement is needed to be able to handle the forces of detonation and convert the energy burst created into useful work.

Electronic valves and injectors are not yet developed to attain the ultra high frequencies of on/off times which peak engine speeds above 7,000 cycles per minute. This is also why electronic fuel injection on a high speed internal combustion engine is not possible. Also with the injection of fuel into the combustion chamber to be mixed there with air or oxygen, time plays a very important part, and the fuel/air mixture does not have adequate time for complete mixing which in turn limits the engine's capability to attain the detonation cycle and ultra high speeds.

Current ultra high speed engines rely on porting for the transfer of a premixed fuel charge into the combustion chamber. These engines are designed to run at a specific frequency in order to obtain best results in performance and emissions. At other speeds either above or below the frequency the porting is designed for, the timing and flow characteristics of the fuel charge and exhaust gases do not work together in harmony to obtain the desired effect, rather part of the fuel mixture short circuits out the exhaust creating pollution, or inadequate scavenging occurs reducing engine performance.

The need for a small, portable, lightweight power source with low pollution levels, and having multifuel capability exists, and our dependence upon imported oil must cease if we are to be a free country that can grow and prosper with an unlimited potential.

The disclosed inventive engine is small in size, because it produces a large amount of power for its displacement. The inventive engine is lightweight, as one half of its components are made of plastic. The inventive engine requires low maintenance as all forces generated are kept within a straight line. The inventive engine generates no destructive side forces which tend to wear components, and has a reduced fuel consumption, estimated to be about 30 to 40% less than in conventional engines of similar displacement, and has a modular design which enables fast easy servicing, and has low emissions because of the unique way in which fuel is regulated to the engine and how the engine uses such fuel, which because of this efficiency and low emissions cuts down on the amount of carbon dioxide being generated daily and practically eliminates generation of carbon monoxide and nitric oxide, and exhaust of unburned hydrocarbons.

The disclosed inventive engine will also provide excellent acceleration capability, a high top speed, a greater range of traveling per tank of fuel, a very low rate of emissions and a very low operating cost.

Manufacturing costs will be comparable to that of today's engines, as although the inventive engine has far fewer parts, those parts require more exacting quality and materials.

The need for currently required costly transmissions will be eliminated and the disclosed engine will provide a means for alternative continuously variable transmissions being either hydraulic or electric.

Vehicle designers will not be limited and whole new design concepts will emerge as the engine will be able to be placed anywhere within a vehicle because there is no mechanical energy transmission and hydraulic and/or electrical lines may be routed to power takeoff areas.

The engine will have the ability to be portable through quick disconnect devices and be able to be used for many purposes, from powering the home, to powering the auto, to powering aircraft, to powering boats, to powering machinery, etc.

Our battle with pollution to the environment will be greatly enhanced, we will not need to keep buying a new car every 5 years, and the dollars we would spend on such purchases could be put to better use, to propel our country into a new age where we will grow strong and be a leader once again.

It is an important object of the present invention to provide a free-piston two stroke cycle engine which is an improvement over the engines of the patents listed and discussed above and other prior art engines.

It is another important object of the invention to provide a free-piston two stroke cycle engine of increased efficiency.

It is an additional important object of the invention to provide a free-piston two stroke cycle engine of minimal moving parts.

It is a further important object of the invention to provide a free-piston two stroke cycle engine which does not lose any raw fuel out the exhaust at any frequency of operation.

It is still another important object of the invention to provide a free-piston two stroke cycle engine with certain components of modular construction to reduce assembly and maintenance costs.

The foregoing and additional objects and advantages of the invention will appear hereinafter.

SUMMARY OF THE INVENTION

The inventive engine is a symmetrically designed, variable compression, free-piston, two stroke cycle engine having a built in supercharging chamber. The engine is run by kinetic energy generated from detonation (spontaneous combustion) of any of a variety of fuels, or blends thereof. Generated pollutants are very low and thermal efficiency is extremely high. The engine may be used as an electrical generator alone, may be used to supply working fluid to a pump chamber, or a combination of both.

The inventive engine comprises two directly opposed identical internal combustion cylinder heads, or simply cylinders, each providing a sealed cavity. The cavities have axial ends which are remote from and confront each other. A piston rod assembly includes a piston in each cylinder cavity and a piston rod joining the pistons, and means for timing the engine and converting energy between the cylinders. Each piston is confronted by the axial end of its associated cavity. The engine runs at ultra high speeds and is practically vibration free. There are no side forces, because all energy is concentrated in a straight line, and friction is minimal. The cylinders function as power producing chambers. Power transfer modules are connected to the cylinder heads. A timing module is between the power transfer modules. The piston rod passes through the timing module and power transfer modules and magnetic pistons are mounted on the piston rod midway between the piston rod ends and its center and a timing slot is located at the center of the piston rod.

The piston rod assembly floats freely within the engine, with power being transferred from fuel combustion to the piston rod assembly causing movement of said assembly, and then into magnetic fields generating current and/or into a working fluid such as hydraulic power system.

The inventive engine when running is always in a power generating mode, as the compression stroke for one end of the piston rod assembly is the power stroke for the other end of the piston rod assembly.

The inventive engine operates on the phenomenon of spontaneous combustion, commonly called detonation. This results from high pressures and temperatures within the combustion chambers or cylinders as the piston compresses the fuel to the point of spontaneous combustion. The fuel does not burn progressively across the combustion chamber, but rather burns or explodes all at once. Normal combustion may boost cylinder pressure from 150 psi to 600 psi in a relatively slow controlled fashion. Detonation can boost cylinder pressure an additional 300 psi almost instantaneously. The normal rate of flame propagation is 25 to 75 feet per second, which is a goal in conventional engines, but the same fuel, when detonated, has a linear speed of 4000 to 5000 feet per second, an enormous increase.

Because of the extremely fast burning associated with detonation, in the inventive engine heat loss out the exhaust and into the cylinder head is substantially eliminated. Heat flow into the cylinder head requires time, which detonation reduces to a very small fraction of what it was with conventional engines. Energy loss in the combustion process varies directly with the square root of the time it takes to complete the burning. In the inventive engine, because all of the fuel is burned while the piston is near its associated cylinder head, the expanding gases are cooled in accordance with gas laws. Energy loss out the exhaust is proportional to the temperature of the exhaust gas. In the inventive engine, power production is concentrated in about the last 1/13 of the stroke of each piston as it approaches the confronting axial end of the cavity of its associated cylinder. As a result, complete combustion and low emission are assured, and the temperature of the exhaust gas is reduced from about 1000 degrees C. to about 300 degrees C. In connection with the statements in this paragraph, see the article entitled "Free-piston Engine" on pages 72 and 73 of "Popular Science" for June 1980, particularly the last two full paragraphs in the first column on page 73.

Because the inventive engine works on detonation, there is no detrimental effect on the engine because its components are centered and the energy burst goes into moving the piston rod assembly, the piston is not moved on its power stroke by expansion of the flame as in conventional engines, but by a shock effect that imparts kinetic energy to the piston rod assembly, thereby instantly storing almost all generated force into a moving mass which may be used for work.

The top speed of the inventive engine is in the range from 25,000 to 30,000 cycles per minute, which results from detonation. Vibration is extremely low because the piston rod assembly, which is the only major moving part, is not attached to the balance of the engine in any way, but instead merely floats in its bore and does not transmit its reciprocating forces to the balance of the engine, simply absorbing these forces within itself. The piston rod assembly is thrown back and forth, detonation forces acting against momentum forces, the developed energy being used for work by power transfer sections of the engine.

As the piston rod assembly undergoes a power pulse from either of the cylinders, kinetic energy is imparted to the piston rod assembly, sending the mass thereof moving toward compression and ignition in the opposing cylinder. Along the way, energy is extracted from the moving mass via hydraulic cylinders moving a fluid and/or electrical energy generated from moving magnets within coils.

The central part of the engine, which is equispaced from the two cylinders, senses how fast the piston rod assembly is moving and adjusts power extraction from the piston rod assembly accordingly, leaving enough energy in the moving mass to compress a fuel mixture to detonation in the cylinder toward which the piston rod assembly is moving, thereby to send the mass in the reverse direction.

Compression ratios in the inventive engine are variable, as the piston rod assembly is not connected to the balance of the engine. A computer operating system senses power desired, combustion properties of the fuel and energy generated from the fuel on detonation, and alters the power extracted from the moving mass of the piston rod assembly, and can alter the fuel ratios, thereby enabling the engine to operate throughout a wide range of fuels and power outputs.

The performance and horsepower curve of the inventive engine shows a steady rise with cycles per minute. The higher the cycles per minute, the more fuel moves through the engine and the higher the total output power.

There is no need for exotic high octane fuels. A gallon of low octane gasoline contains just as much heat energy as high octane gasoline, and can move a given mass just as far; and more gallons of low octane gasoline and other less critical fuels are obtainable out of a single barrel of crude oil. The inventive engine runs on a wide variety of fuels and prefers the lighter cheaper grades. It also runs on gaseous fuels such as propane, natural gas, methane, etc. The ultimate fuel for the engine is hydrogen. The hydrogen/air fuel mixture works exceedingly well, and the hydrogen/oxygen fuel mixture is the ultimate for this engine, since it can handle the tremendous power generated without harm to the engine whatsoever.

With ceramics, lubrication is not needed. Without piston lubrication, there is little need to cool the engine, since the oil film between piston and cylinder in a conventional engine is more sensitive to high temperatures than the engine structure. The pistons are the most critical structural elements, and should be made of heat resistant material such as ceramic.

Friction is minimal within the inventive engine, as there are no side forces as in a conventional engine. Three rings per piston are needed to prevent any blowby into either the precompression chamber or the combustion chamber (and out the exhaust).

DESCRIPTION OF THE INVENTION

Figure 1:
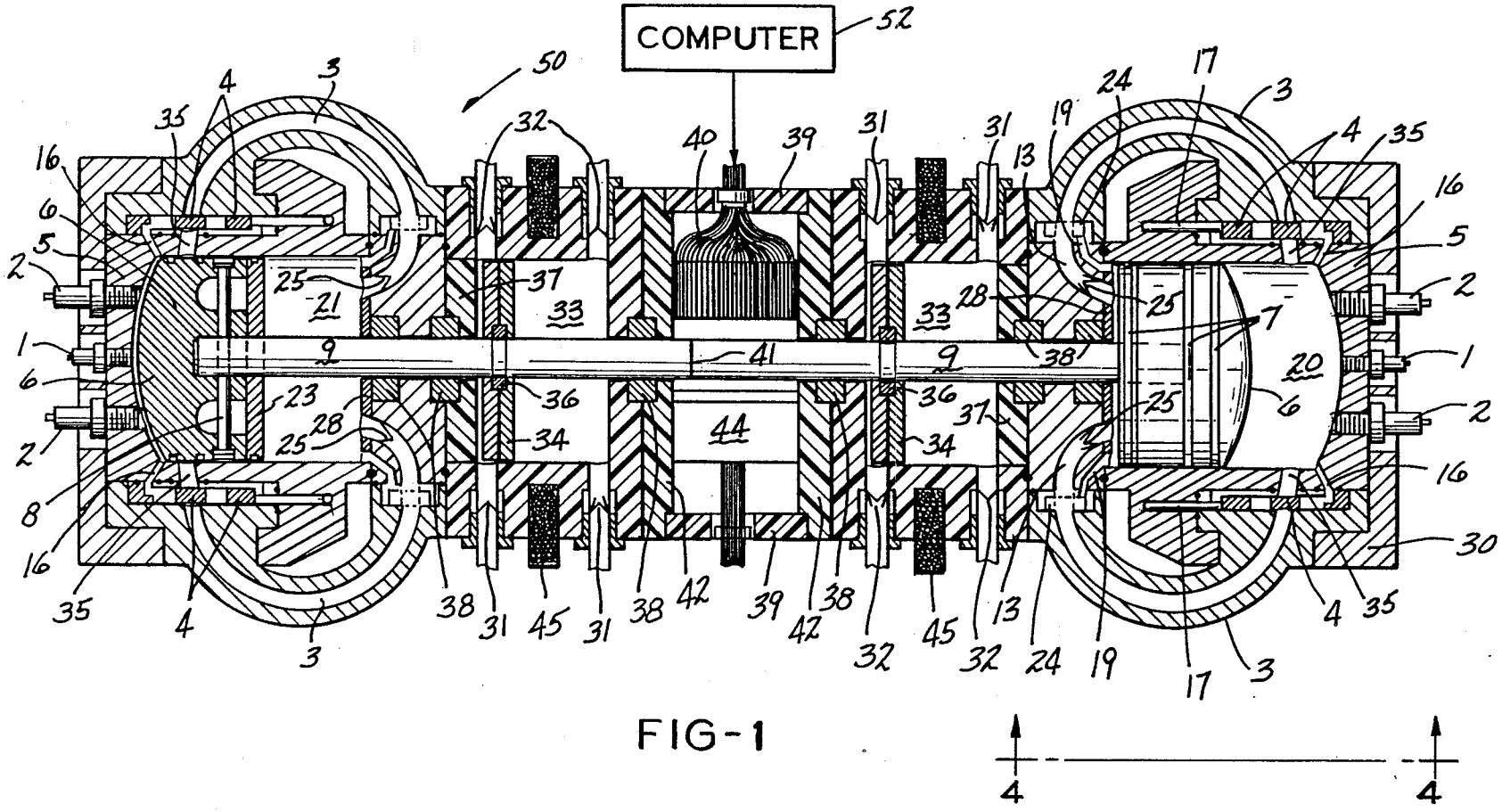
FIG. 1 is an axial sectional view of an engine which is a preferred embodiment of the invention, showing the connecting rod and pistons at the extreme left end of their stroke.
Figure 2:
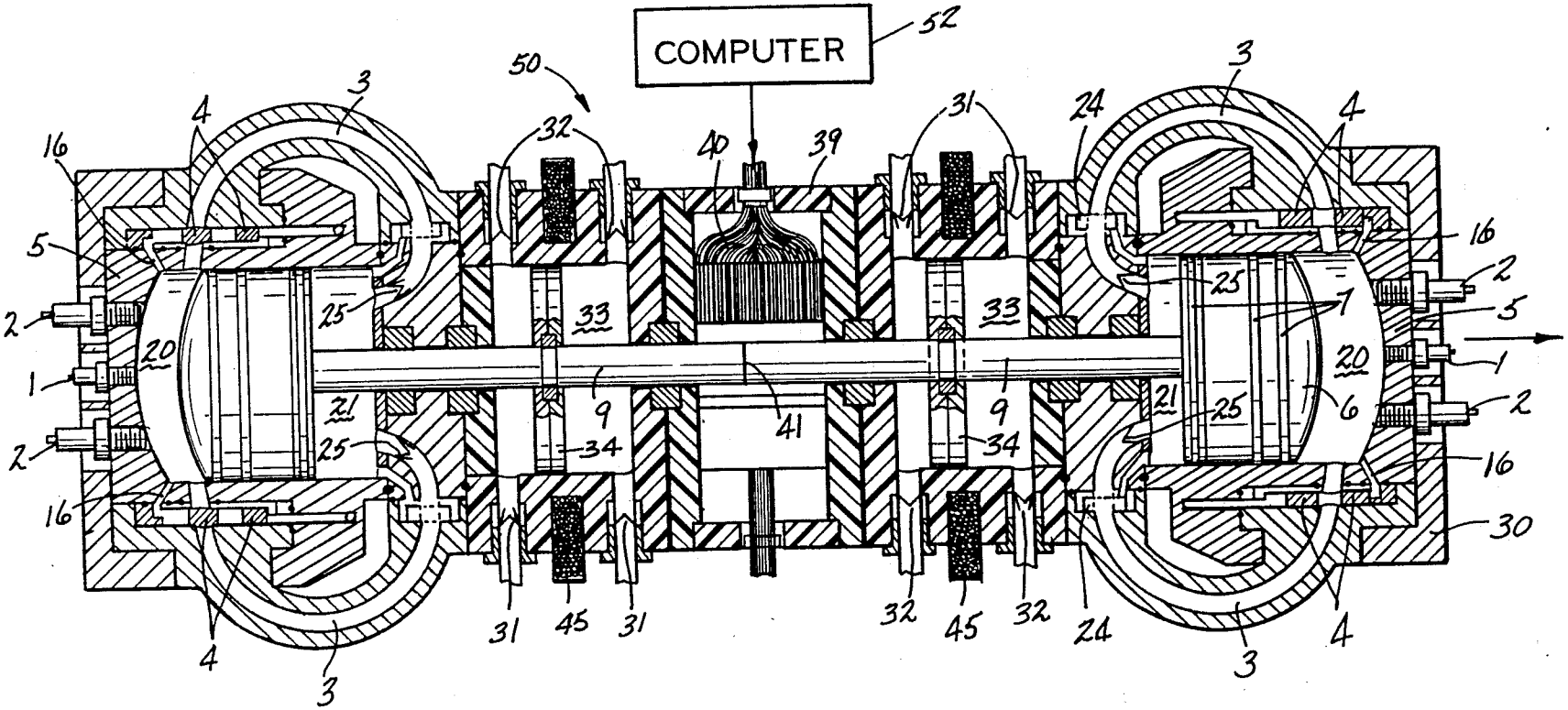
FIG. 2 is a view similar to FIG. 1 but showing the connecting rod and pistons approaching the midpoint of their stroke as they travel from left to right.
Figure 3:
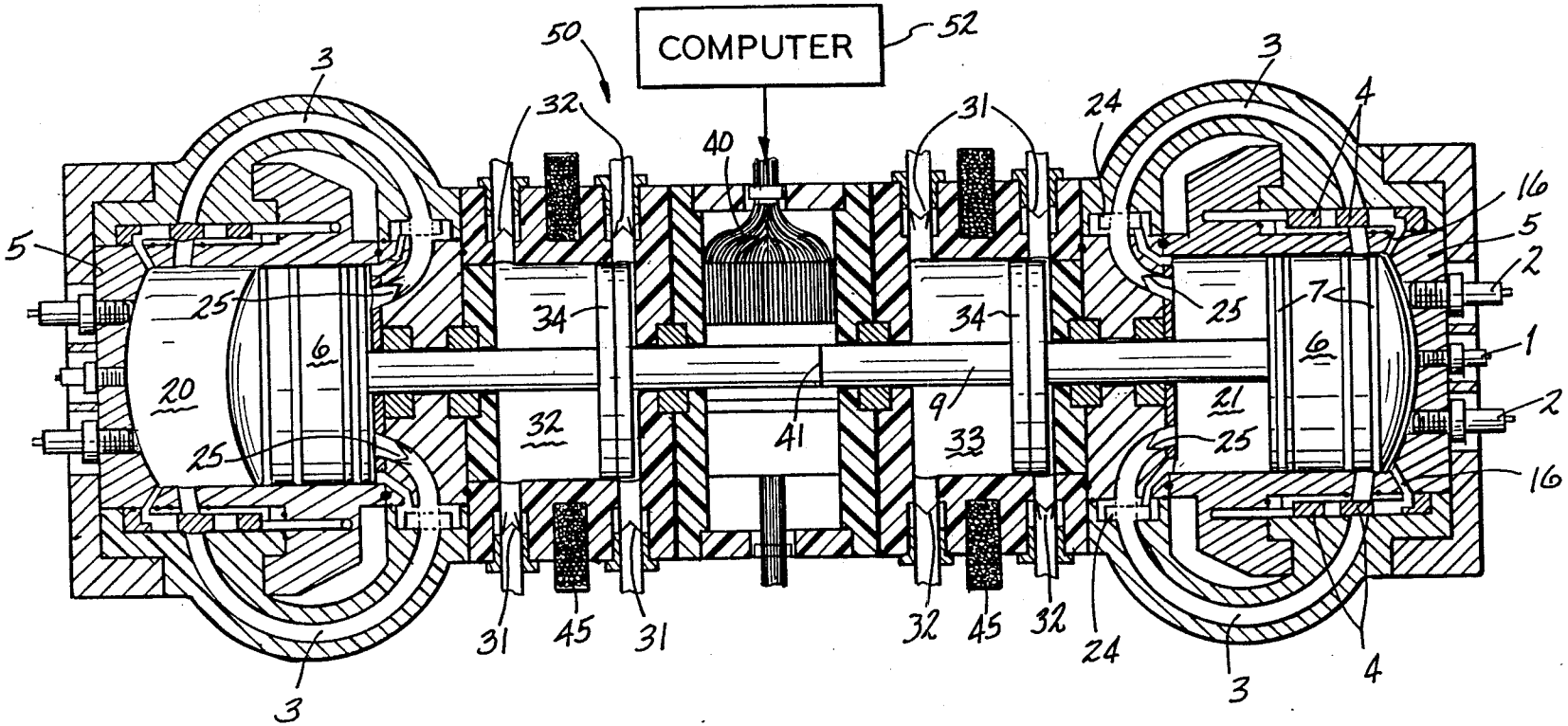
FIG. 3 is a view similar to FIG. 1 but showing the connecting rod and pistons at the extreme right end of their stroke.
Figure 6:
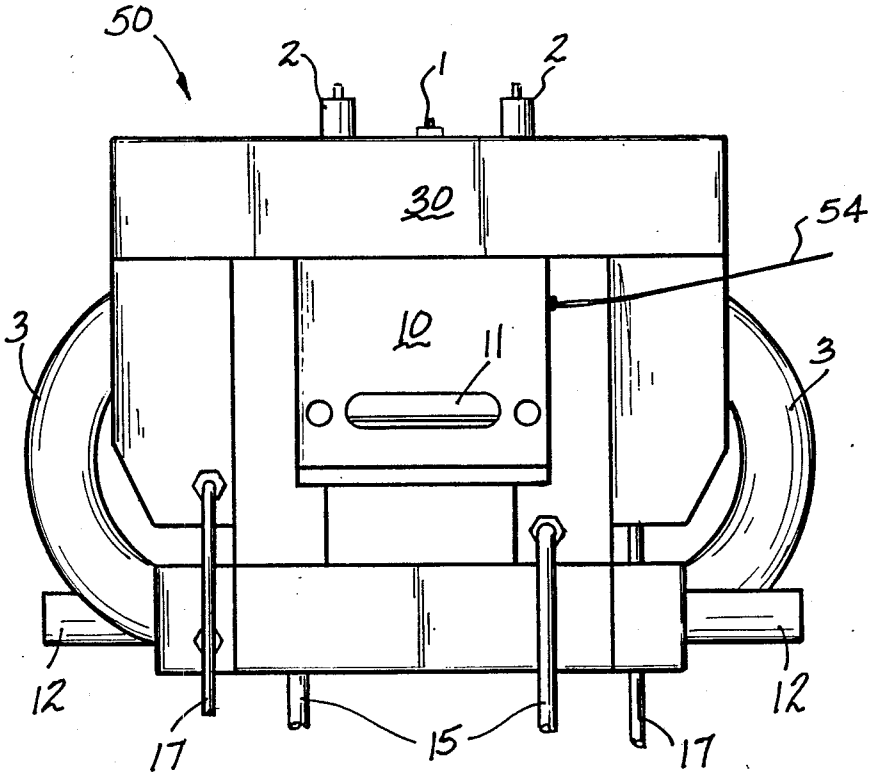
FIG. 6 is an external fragmentary view taken substantially on line 6—6 of FIG. 4.
Figure 4:
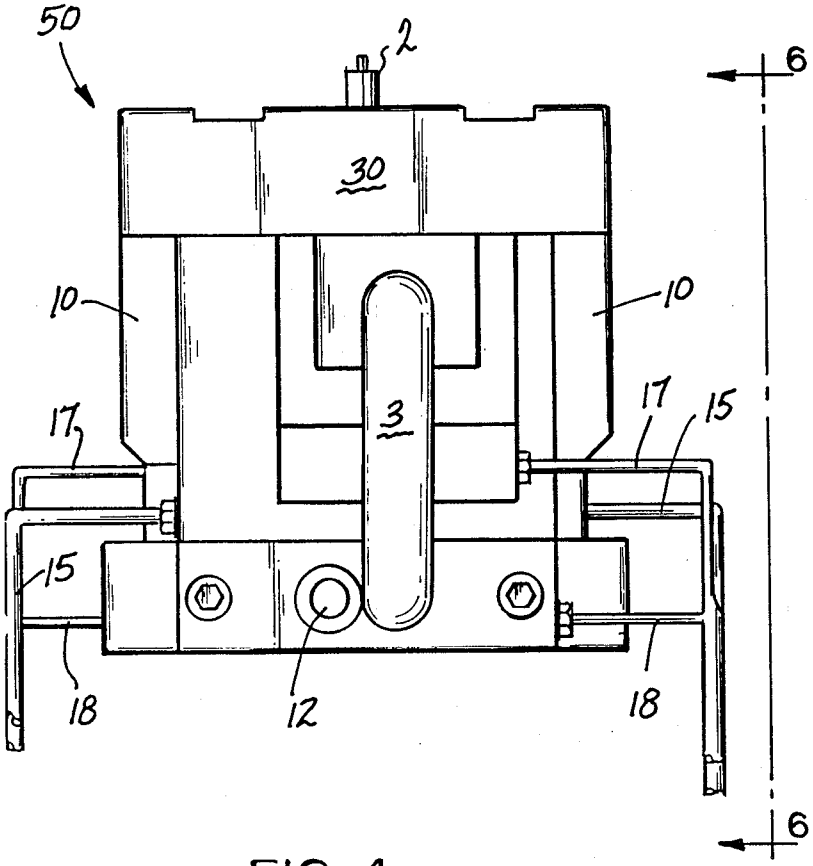
FIG. 4 is an enlarged, external fragmentary view taken substantially on line 4—4 of FIG. 1.

FIG. 1 illustrates in axial section a two stroke cycle engine 50 which is a preferred embodiment of the invention. FIGS. 2 and 3 show substantially the same parts as FIG. 1 and will be specifically mentioned below.

A major component of engine 50 is a piston rod assembly which includes a connecting rod 9 and two power pistons 6, one affixed to each end of rod 9. Piston 6 at the left hand end of FIG. 1 shows its internal construction and that it is hollowed out for light weight and is affixed to rod 9 by a piston pin 8 passing through rod 9 and through the outer walls of piston 6. FIG. 1 also shows that the face of piston 6 which confronts the opposite piston 6 is covered by a piston cover plate 23.

The axial ends of pistons 6 remote from each other are provided by convex surfaces. Midway between each end of rod 9 and its center, a double sided two-piece power transfer piston 34 of high strength permanent magnet material is attached to rod 9 via a two-piece clamp 36. The longitudinal center of rod 9 has a timing slot in the form of a circumferential groove 41 therearound, for a purpose set forth below. The piston rod assembly is a free floating unit of engine 50.

Engine 50 further has two linearly opposed cylinder heads or simply cylinders 5 having sealed cavities in which pistons 6 are located for reciprocating motion. The sealed cavities have concave axial ends confronting, and of the same radius of curvature as, the convex surfaces of pistons 6. This feature maximizes compression in cylinders 5, enhancing detonation. Cylinder heads 5 may be castings of ceramic material in whole or in part. Each piston 6 has piston rings 7 (three being shown) in slidable engagement with the wall of cylinder 5, to keep pressures and vacuums in their respective chambers. It is noted that two piston rings 7 are spaced close to each other near the axial end of piston 6 remote from rod 9 and the third ring 7 is spaced a considerable distance from the first two rings 7, in the direction toward the other piston 6.

Centrally located between cylinder heads 5 is a timing module 39 and between timing module 39 and each cylinder head 5 is a power transfer module 33. Cylinder heads 5, power transfer modules 33 and timing module 39 provide engine 50 with an outer shell which is stationary. Thus, pistons 6 are located within cylinder heads 5 and connecting rod 9 passes through power transfer modules 33 and power transfer pistons 34 are within power transfer modules 33. Each power transfer module 33 provides a cylinder in which its associated power transfer piston 34 reciprocates, causing the pumping of fluid, such as hydraulic fluid, thus converting internal combustion energy into high pressure fluid flow.

Figure 5:
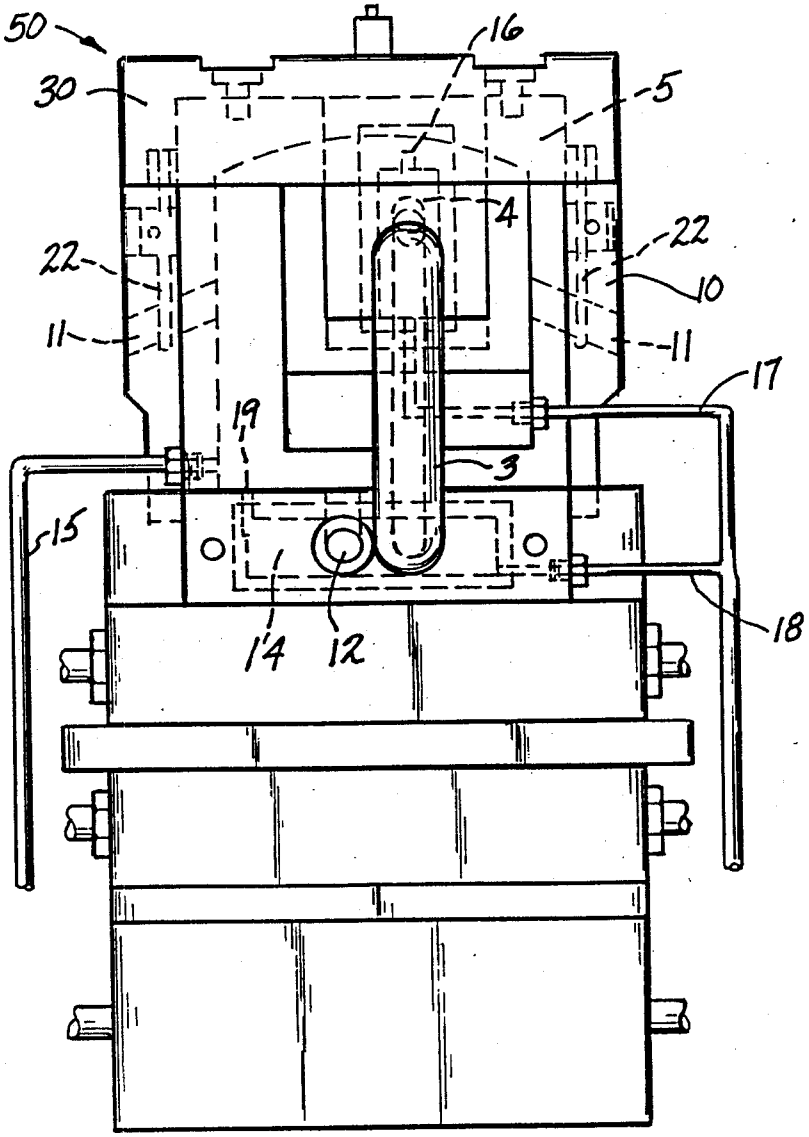
FIG. 5 is a semi-internal view of what is shown in FIG. 4.
Figure 7:
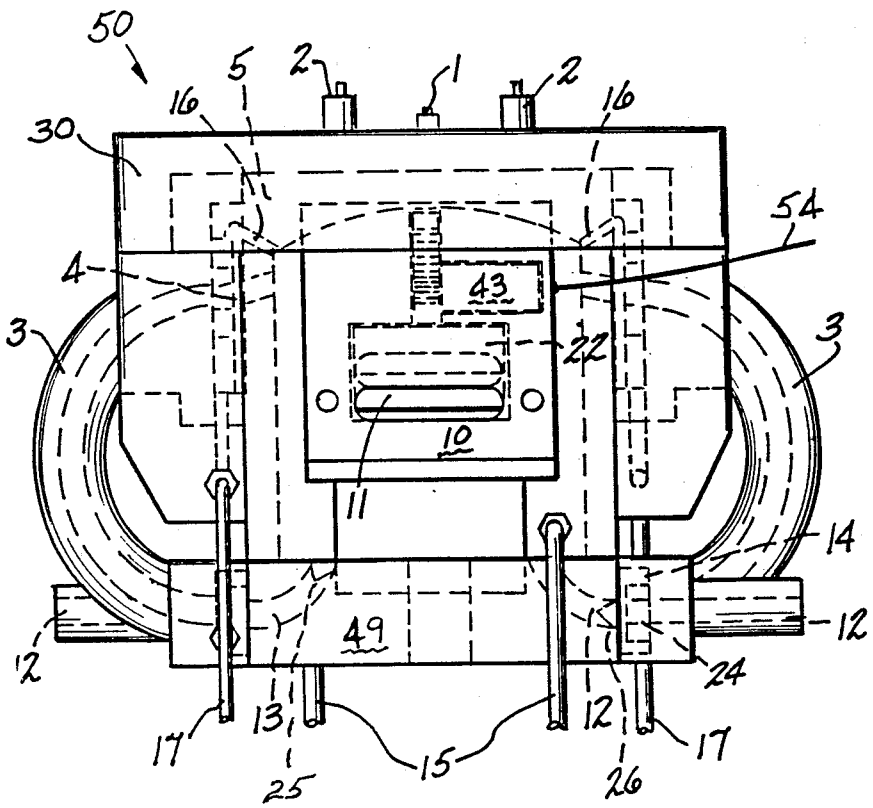
FIG. 7 is a semi-internal view of what is shown in FIG. 6.

In each cylinder head 5 are two spark plugs 2, a pressure sensor 1, injector ports 35, injector pressure channels 16 and 17, pressure vacuum channel 15 and exahust ports 11, which may be viewed in FIGS. 1, 5 and 7. Also affixed to each cylinder head 5 are external accumulators or transfer tubes 3 which also serve to provide a housing for injector gate 4 and intake/transfer gate 24, pressure channel 17, pressure/vacuum channel 18, and intake port 12 (FIGS. 5 and 7). Each cylinder head 5 also has affixed to it an exhaust manifold 10 which incorporates exhaust port 11, exhaust delay valve 22, and servo motor 43 (FIGS. 5 and 7). Each cylinder head 5 also has a cylinder head cap 30, and an intake/transfer manifold 49 which includes intake ports 12, transfer ports 13, reed valves 25 and 26, seals 38, and cover plate 28 (FIGS. 1, 5 and 7).

Power transfer modules 33 are cylindrical bodies, each with an inner bore slightly larger in diameter than power transfer pistons 34, and an axial end adjacent timing module 39 holding a high pressure seal 38 through which piston rod 9 passes and reciprocates. Power transfer modules 33 also have end plates 37 which are remote from timing module 39 and also holding high pressure seals 38 through which piston rod 9 passes and reciprocates. Each power transfer module 33 also has two fluid input passages 31, each with a reed valve, and two fluid output passages 32, each with a reed valve. Each power transfer module 33 also has around its diameter wire coils 45 which generate electrical current when they are axially traversed by their associated magnetic power transfer pistons 34.

Timing module 39 is equidistant from cylinder heads 5. Within timing module 39 are a light bar 44, timing housing end plates 42 and fiber optic sensors 40. An operating computer 52 is used in known fashion to scan fiber optic sensors 40 to locate the position of rod 9 with the aid of circumferential groove 41.

Advantageously, power transfer module 33, end plates 37, timing modules 39 and end plates 42 are made of plastic material. Suitable high strength plastics that are highly resistant to heat distortion include thermoset phenolics, polyimides and the like, and thermoplastic resins such as nylon, polyetherimides, polysulfones and the like.

Pressure sensors 1 sense pressures and relay data pertaining thereto to operating computer 52, as to which more is said below.

Each transfer tube 3 extends from an inlet end in communication with the bottom of its associated cylinder 5 to an outlet end in communication with the side wall of its associated cylinder 5 at a location substantially maximally spaced from the inlet end. The bottom of each cylinder 5 is covered with a cover plate 28 which retains intake reed valves 25 and adjacent seal 38. The space between each piston 6 and the bottom of its cylinder 5 is a precompression chamber 21 while the space between each piston 6 and the confronting end of the sealed cavity of its associated cylinder 5 is a combustion chamber 20.

Each injector gate or valve 4 is actuated by pressures within its associated combustion chamber 20 and partial vacuums and pressures within precompression chamber 21 of opposite cylinder 5, acting on gate 4 through pressure channel 17, there being one injector gate 4 associated with each transfer tube 3. Valves 4 admit the pressurized fuel mixture in tubes 3 to their associated combustion chamber 20 at a desired time which is related to the position of the piston rod assembly.

An intake/transfer valve or gate 24 is associated with each transfer tube 3, and intake port 12. Each valve 24 is a double acting valve for controlling the induction and transfer of fuel to and from precompression chamber 21.

Each valve is connected to precompression chamber 21 of opposite cylinder 5 via pressure/vacuum channel 18.

Fuel is inducted into precompression chamber 21 via intake ports 12, intake/transfer gate 24, and reed valve 26. Fuel is then precompressed by piston 6 and moved to transfer tube 3 via transfer port 13, reed valve 25 and intake/transfer gate 24 (FIGS. 5 and 7).

Each intake/transfer gate 24 is connected to precompression chamber 21 of the same cylinder 5 via pressure/vacuum channel 19. Each gate 24 is also connected to precompression chamber 21 of opposing cylinders 5 via pressure/vacuum channel 18 of the same cylinder 5 which in turn connects to pressure/vacuum channel 15 of the opposing cylinder 5 (FIGS. 5, 7 and 8).

Figure 8:
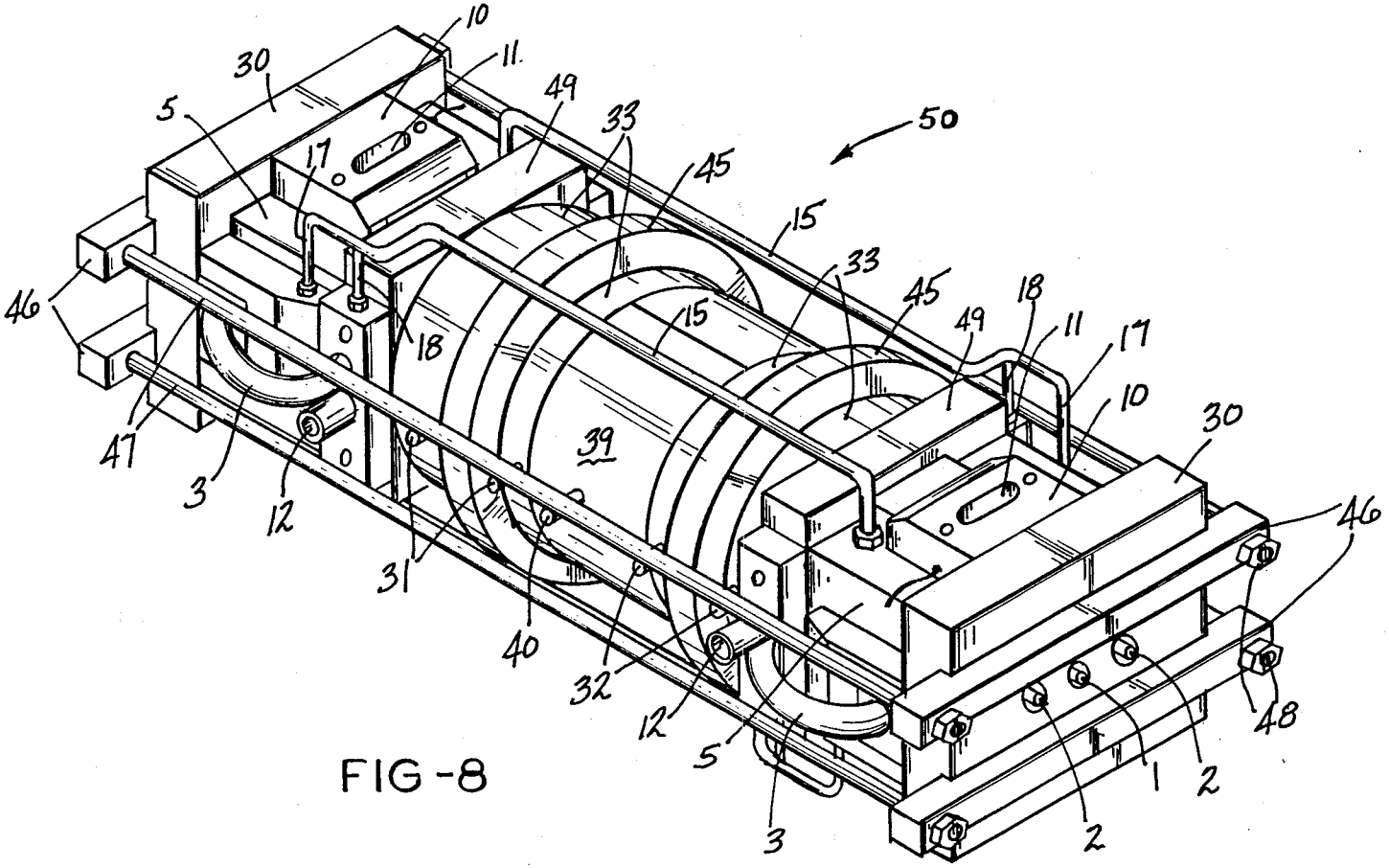
FIG. 8 is an external perspective view of the engine.

FIG. 8 shows engine 50 in external perspective. Particularly noteworthy in FIG. 8 is its showing of means for releasably holding the operative parts or modules of engine 50 together. These means comprise four hold down bars 46, four hold down rods 47 and eight nuts 48. Cylinders 5, power transfer modules 33 and timing module 39 are depicted releasably held together by hold down bars 46, two of which are in engagement with one cylinder head cap 30 and the other two are in engagement with the other cylinder head cap 30, thus to provide two aligned pairs of hold down bars 46, each of which has two holes therethrough adjacent opposite ends thereof. Each hold down rod 47 has external threads at each end, and the threaded ends of each hold down rod 47 extend through a hole through each of two hold down bars 46. Nuts 48 are turned into threaded engagement with the protruding threaded ends of hold down bars 46, thus to clamp head caps 30 against cylinders 5, cylinders 5 against power transfer modules 33 and power transfer modules 33 against timing module 39, to hold the operative parts of engine 50 together.

It is believed that the rest of what is depicted in FIG. 8 is largely self-evident, but it is pointed out that FIG. 8 shows that pressure/vacuum channel 17 and pressure/-vacuum channel 18, which exit from one cylinder 5, join each other to form pressure/vacuum channel 15 which connects to the other cylinder 5.

In FIG. 1, lefthand piston 6 is at its relative top and righthand piston 6 is at its relative bottom, i.e., in lefthand cylinder 5, precompression chamber 21 is at maximum volume and combustion chamber 20 is at minimum volume, whereas in righthand cylinder 5, precompression chamber 21 is at minimum volume and combustion chamber 20 is at maximum volume. Also, power transfer pistons 34 are at the leftmost extreme positions of their travel. Reed valves 25 associated with lefthand cylinder 5 are closed and reed valves 25 associated with righthand cylinder 5 are open. All injector gates 4 are closed. Power transfer pistons 34 are at the leftmost ends of their travel in the cylinders of power transfer modules 33. Fluid input valves 31 to the right of pistons 34 are open and the other fluid input valves 31 are closed. Fluid output valves 32 to the right of pistons 34 are closed and the other output valves 32 are open.

In FIG. 2, in which the piston rod assembly is moving to the right as indicated by the arrow, lefthand piston 6 has moved about one third of the way from its relative top toward its relative bottom and righthand piston 6 has moved about one third of the way from its relative bottom toward its relative top. In this condition, the volume of lefthand precompression chamber 21 is equal to $\frac{2}{3}$ its max volume, and the volume of righthand precompression chamber 21 is equal to $\frac{1}{3}$ its max volume. The volume of lefthand combustion chamber 20 is equal to $\frac{1}{3}$ its max volume, while the righthand combustion chamber 20 is equal to $\frac{2}{3}$ its max volume. Also, power transfer pistons 34 are at one third of their travel. Reed valves 25 associated with lefthand cylinder 5 have opened, and reed valves 25 associated with righthand cylinder 5 have closed. Injector gates 4 associated with lefthand cylinder 5 remain closed, but injector gates 4 associated with righthand cylinder 5 have opened. Power transfer pistons 34 are at $\frac{1}{3}$ of their travel in the cylinders of power transfer modules 33. Fluid input valves 31 to the left of pistons 34 have opened and fluid input valves 31 to the right of pistons 34 have closed. Fluid output valves 32 to the left of pistons 34 have closed and fluid output valves to the right of pistons 34 have opened. Although invisible in FIG. 2, exhaust ports 11 associated with righthand cylinder 5 have just been closed (covered) by the piston 6.

In FIG. 3, in which the piston rod assembly has proceeded from the position shown in FIG. 2 to its rightmost position in which lefthand piston 6 is at its relative bottom and righthand piston 6 is at it relative top, i.e. in lefthand cylinder 5, precompression chamber 21 is at minimum volume and combustion chamber 20 is at maximum volume, whereas in righthand cylinder 5, precompression chamber 21 is at maximum volume and combustion chamber 20 is at minimum volume. Also, power transfer pistons 34 are at the rightmost extreme positions of their travel. Reed valves 25 associated with lefthand cylinder 5 remain open, and reed valves 25 associated with righthand cylinder 5 remain closed. Injector gates 4 associated with righthand cylinder 5 have reverted to their closed positions. Fluid input valves 31 and fluid output valves 32 remain as in FIG. 2. It is assumed that detonation has just taken place supplying impetus to the piston rod assembly to drive same to the left, back toward the position shown in FIG. 1.

Starting Mechanical Movement Engine Dynamics

When engine 50 is to be started, computer 52 is energized. Computer 52 scans fiber optic sensors 40 in timing module 39 to locate the position of the piston rod assembly by determining the position of groove 41 on piston rod 9, and to lower exhaust delay valves 22. Coils 45 are then energized to move the piston rod assembly back and forth between the confronting concave axial ends of the sealed cavities of cylinders 5 to establish a fuel flow into precompression chambers 21.

As engine 50 is in its starting mode, the fuel mixture is precompressed, transferred into an accumulator 3, then injected into combustion chamber 20.

As piston 6 rises in its bore, operating computer 52 senses its position and speed. It calculates the optimum firing position, then fires the spark plugs 2 to initiate combustion. Spark plugs 2 are used for starting and low speed running of engine 50.

As mentioned above, as engine 50 is started, operating computer 52 lowers exhaust delay valves 22, to their most nearly closed positions at which exhaust ports 11 are approximately one third open. As engine cycles per minute increase, computer 52 instructs stepper motor 43 to open valves 22, the degree of openness being determined by engine speed, and other parameters.

For low speeds, when valves 22 are most nearly closed, pressure is kept within combustion chamber 20 a bit longer, thereby enabling engine 50 to make useful power at low speeds. As engine 50 rises in cycles per minute, the time in which exhaust ports 11 are uncovered by piston 6 allowing exhaust out is shorter. Thus, as engine 50 rises in speed, exhaust delay valve 22 is opened more by operating computer 52, thereby creating a larger area in exhaust port 11 through which exhaust gases can escape. Also, delay valve 22 regulates the amount of exhaust gas recirculation, which enhances both the ability to control emissions and power output.

Two terms mentioned above are "relative top" and "relative bottom". These terms are used to denote the position of any piston 6 when its precompression chamber 21 is of maximum size and the position of that piston 6 when its compression chamber 20 is of maximum size. Thus, in FIG. 1, left piston 6 is at its "relative top" and right piston 6 is at its "relative bottom", whereas in FIG. 3, left piston 6 is at its "relative bottom" and right piston 6 is at its "realtive top". These defined terms include the word "relative" because the piston rod assembly is free and may assume any compression ratio, dependent upon force imparted to it from combustion in one cylinder 5, the extraction of energy from the piston rod assembly in its travel toward compression in opposing cylinder 5, and such parameters as compression, ignition, and expansion of the fuel, thereby stopping and reversing the movement of the piston rod assembly.

As the piston rod assembly shuttles back and forth, pressures and vacuums are created. These pressures and vacuums are utilized in opening and closing valves.

As piston 6 moves from relative bottom toward relative top, a partial vacuum is created below it in precompression chamber 21. This vacuum acts upon intake/-transfer valve 24 through channel 19 causing the valve to be moved to the intake open position. This vacuum also works through pressure channel 15, connecting with channel 18, going to the opposing cylinder's intake/transfer valve 24, to pull that valve to the transfer open position. Intake/transfer valve 24 can only be in one of two positions: (1) intake open—transfer closed, or (2) intake closed—transfer open. At the same instant of time that the first piston is moving toward its relative top, the opposing piston is moving toward its relative bottom and pressure is building up within its precompression chamber 21. This pressure acts to push the intake/transfer valve 24 to the transfer open position within opposing cylinder 5, via channel 19. Also, pressure within precompression chamber 21 of opposing cylinder 5 acts through channel 17 to open injector valve 4 within original cylinder 5 as piston 6 in that cylinder 5 is rising toward relative top and has just covered exhaust ports 11.

This allows the pressurized fuel within the accumulator tubes 3 to be admitted into the combustion chamber 20 after the exhaust ports are closed. When sufficient pressure has built up within combustion chamber 20, that pressure acts upon injector valve 4 through channel 16 to close injector valve 4.

As either piston 6 rises to compression ignition, power is generated by combustion and sends the piston rod assembly in the opposite direction. The last-mentioned piston 6 is now traveling toward relative bottom, and pressure builds up within its precompression chamber 21, and inducted fuel is not allowed to backflow out the intake because of check valves 26. As pressure buildup occurs within precompression chamber 21, that pressure acts to (1) open injector valve 4 of opposing cylinder 5 and (2) move the transfer/intake valve 24 to the transfer open position within the same cylinder 5, and (3) move intake/transfer valve 24 in the opposing cylinder 5 to the intake open position. When valve 24 is in the transfer open position, pressurized fuel is then transferred to accumulator tubes 3 from precompression chamber 21. As piston 6 reaches its relative bottom position, and starts upward toward its relative top, pressurized fuel within accumulators 3 is not allowed to backflow because of check valves 25. This completes the description of one cycle of engine 50.

As engine 50 is in its starting mode, computer 52 senses when piston 6 has reached its relative top and fires spark plugs 2, causing combustion and pressure, sending the piston rod assembly in the opposite direction, and into injection, compression and ignition in opposite cylinder 5.

As engine 50 starts running, the coils that propelled the piston rod assembly go into a current generating mode caused by the high strength magnetic material used for power transfer pistons 34. Also, the power transfer cylinders 33 may be used to pump a fluid. The operating system then gains data on the fuel being used, by combustion characteristics within combustion chamber 20, through pressure sensors 1, and velocity of the piston rod assembly 9. It then tailors the fuel accordingly for maximum performance and low emissions.

Fuel is not metered mechanically as in a carburetor, or electronically as with the current injection systems. A carburetor relies on a low pressure area within the throttle body to pull fuel into the airstream, the amount metered by needles and jets which are unable to vary ratios. Electronic injection uses a computer to switch the injector on and off, the ratio varying with the length of on time, though they approach a limit within a 2 stroke of approximately 7,000 cycles per minute. Accurate fuel metering ratios are lacking within the carburetor and incomplete mixture is lacking with the injection system.

Within engine 50 fuel is drawn in by the partial vacuums created below each piston 6 in its precompression chamber 21. Fuel is metered and ratios are varied by computer control of a valve which is constantly open, though the degree of openness varies with load, acceleration and emission control. Because of the free piston movement, whereby the piston rod assembly is not limited to a specific compression ratio and movement, as engine 50 is running and rises in cycles per minute (frequency) it soon attains compression pressures where self ignition (or detonation) occurs. When engine 50 is within this operating mode, spark plugs are no longer used to initiate combustion.

Because engine 50 is multi-fuel capable, upon explaining the engine's principles, concentration will be given to hydrogen, as it is the cleanest and most abundant fuel we have. Characteristics of other fuels are somewhat similar, and the heavier fuels take a bit longer to dissociate from themselves and associate into their combustion products.

A study carried out in part by the Jet Propulsion Laboratory into the characteristics of hydrogen in an internal combustion engine concluded that true compression ignition of hydrogen and air has never been observed in hydrogen engines independent of surface ignition. Pressure and temperature of the mixture after compression by a ratio of 29:1 are such that explosion certainly would occur if the mixture were left undisturbed. However, in the engine the mixture is soon expanded again because of piston crankshaft movement. The ignition lag times apparently are too long compared with the time available. This is not the case with engine 50. Because there is no crankshaft or other action to limit the compression ratio of the motor, the higher compression ratios are only limited by the self ignition and expansion of the fuel used. By the free movement of the piston rod assembly and the kinetic energy it possesses from an explosion in an opposing cylinder, extreme ratios are possible. The limiting factors would be how much energy is extracted from the assembly, determined by the computer operating system, and the compression-ignition point of the fuel. Thus it is possible to achieve compression-ignition or detonation of a hydrogen fuel mixture at any reasonable mixture ratio.

Hydrogen is the ideal fuel for engine 50 as it has wide flammability limits for mixture ratios. This allows for unthrottled power regulation of the engine. Hydrogen and oxygen combine at 600 degrees C. with the slightest trace of moisture. If the last traces of moisture are removed, hydrogen and oxygen can be heated to 1000 degrees C. without explosion which allow for high compression ratios. The usual, temperature in a gas engine is 1600 degrees C. however, pure hydrogen and oxygen combine at temperatures of over 3800 degrees C. This extremely high temperature will cause damage to almost any engine. However, engine 50 can withstand these temperatures at relatively high cycles per minute (10,000 to 30,000 cpm) because of the extremely low time these temperatures exist (within a ten-thousandth of a second and less), and the energy is given to the piston rod assembly in the form of a quick burst of kinetic energy, rather than the slow push of expanding gases as in a conventional engine. From that point the gases act in accordance with gas laws and cool with expansion.

Nitric oxide emissions from hydrogen fueled engines are governed by the same thermochemical processes which determine these emissions when hydrocarbon fuels are used. For near stoichiometric mixtures, $NO_x$ emissions with hydrogen are consideralby higher than with hydrocarbon fuels. However, the lean operation possible with hydrogen enables operation in regimes of very low $NO_x$ emissions. Also, hydrogen's rapid burning velocity indicates a high tolerance for EGR control of $NO_x$ without fuel economy penalty. Thus, the flexibility of hydrogen fuel due to its combustion characteristics permits tailoring of the engine to minimize $NO_x$ emissions.

Although the low density of hydrogen would limit the output of a normal engine, engine 50 utilizes a precompression or supercharging chamber 21 to precompress the fuel mixture into a denser form, then store that mixture in accumulators 3 until injected into the combustion chamber 20 at the proper moment.

Use of a "closed" hydrogen-oxygen fuel system would negate any $NO_x$ emissions, and would result in a more powerful fuel charge within the engine thus producing an incredible amount of power when needed. Normal internal combustion engines could not handle the forces that would be generated, but engine 50 could because of its linear free piston rod movement, and high speed capability.

Another attribute to hydrogen is that it associates or burns at an extremely rapid rate which enables the engine to achieve speeds to 30,000 cycles per minute. The true explosive mixture of hydrogen and oxygen gives a velocity of 2841 meters per second.

The gases $H_2$ and $O_2$ in a ratio determined by the operating computer (from power demand), may be pressurized and forced into precompression (or supercharging) chamber 21 on the upstroke of piston 6, thereby causing an initial density much higher than if inducted under partial vacuum conditions.

So it is seen that engine 50 is a high speed free-piston engine and is functional to do work such as move a fluid, to transfer energy from thermochemical energy to electrical energy, to be efficient in converting said thermochemical energy into a working fluid and/or electrical current.

The invention well attains the objects and advantages set forth above, as well as other objects and advantages.

The disclosed details are exemplary only and are not to be taken as limitations on the invention except as those details may be included in the appended claims.

What is claimed is:

1. For use in a free-piston two stroke cycle engine, a piston rod assembly comprising a rigid unitary connecting rod having first and second ends and a longitudinal center, first and second power pistons mounted on said first and second ends, respectively, said connecting rod having, substantially at said longitudinal center, a circumferential groove therearound, said groove providing a slot for use in determining the position and velocity of said piston rod assembly, and first and second power transfer pistons of high strength permanent magnet material rigidly mounted on said connecting rod at first and second locations, respectively, said first location being between said groove and said first end and said second location being between said groove and said second end.

2. A piston rod assembly according to claim 1 wherein said rod has a longitudinal center and said first location is about half way between said first end and said longitudinal center and said second location is about half way between said second end and said longitudinal center.

3. A piston rod assembly according to claim 1 wherein each said power transfer piston is double sided.

4. A piston rod assembly according to claim 1 wherein said rod and said pistons are coaxial.

5. A free-piston two stroke cycle engine comprising a piston rod assembly including a connecting rod having first and second ends, first and second power pistons mounted on said first and second ends, respectively, and at least a first power transfer piston rigidly mounted on said connecting rod at a first location between said first and second ends, and first and second power cylinders having first and second sealed cavities containing said first and second power pistons, respectively, said first and second power pistons being reciprocatable in said first and second cavities, respectively, between relative tops and relative bottoms, such that as either said power piston moves from its relative top toward its relative bottom the other said power piston moves from its relative bottom toward its relative top, the portions of said first and second cavities between said power pistons providing first and second precompression chambers, respectively, and the portions of said first and second cavities on opposite sides of said power pistons providing first and second combustion chambers, respectively, a timing module between said power cylinders, and at least a first power transfer module between said timing module and said first power cylinder, said connecting rod passing through said timing module and said first power transfer module, said first power transfer module including a first power transfer cylinder in which said first power transfer piston reciprocates, wherein said timing module includes a light bar and fiber optic sensors and said connecting rod includes a timing slot around its periphery within said timing module such that said timing slot reciprocates back and forth within said timing module and said fiber optic sensors continuously sense the position of said timing slot to determine the position and velocity of said piston rod assembly.

6. A free-piston two stroke cycle engine according to claim 5 further comprising a computer which scans said fiber optic sensors to locate the position of said piston rod assembly and means controlled by said computer for adjusting the velocity of said piston rod assembly.

7. A free-piston two stroke cycle engine comprising a piston rod assembly including a connecting rod having first and second ends, first and second power pistons mounted on said first and second ends, respectively, and at least a first power transfer piston rigidly mounted on said connecting rod at a first location between said first and second ends, and first and second power cylinders having first and second sealed cavities containing said first and second power pistons, respectively, said first and second power pistons being reciprocatable in said first and second cavities, respectively, between relative tops and relative bottoms, such that as either said power piston moves from its relative top toward its relative bottom the other said power piston moves from its relative bottom toward its relative top, the portions of said first and second cavities between said power pistons providing first and second precompression chambers, respectively, and the portions of said first and second cavities on opposite sides of said power pistons providing first and second combustion chambers, respectively, a timing module between said power cylinders, and at least a first power transfer module between said timing module and said first power cylinder, said connecting rod passing through said timing module and said first power transfer module, said first power transfer module including a first power transfer cylinder in which said first power transfer piston reciprocates, wherein said timing module includes a housing of plastic material and said first power transfer module includes a housing of plastic material.

8. A free-piston two stroke cycle engine comprising a rigid connecting rod having first and second ends, first and second power pistons mounted on said first and second ends, respectively, first and second power cylinders having first and second sealed cavities, respectively, containing said first and second power pistons, respectively, the portion of said first cavity between said power pistons providing a first precompression chamber and the portion of said second cavity between said power pistons providing a second precompression chamber, the portion of said first cavity on the side of said first power piston opposite said first precompression chamber providing a first combustion chamber, and the portion of said second cavity on the side of said second power piston opposite said second precompression chamber providing a second combustion chamber, at least one accumulator connecting said first precompression chamber and said first combustion chamber, and at least one accumulator connecting said second precompression chamber and said second combustion chamber, each said accumulator having an area holding injector gate assembly adjacent its said associated combustion chamber, an area holding intake/transfer gate assembly adjacent its said precompression chamber and an area therebetween for receiving and holding a precompressed fuel-air mixture until it is injected into the associated said combustion chamber.

9. A free-piston two stroke cycle engine according to claim 8 wherein each said injector gate assembly includes a housing and a valve slidably movable within said housing, and a fuel-air mixture flow passageway, said valve having an open position in which said passageway is open and a closed position in which said passageway is closed, and means for controlling said position of said valve by fluid pressure and/or vacuum or electronically.

10. A free-piston two stroke cycle engine according to claim 8 wherein each said intake/transfer gate assembly includes a housing and a valve slidably movable within said housing and having inlet and outlet passages for a fuel-air mixture, said movable valve having an opening corresponding to intake open-transfer closed or intake closed-transfer open, depending on the position of said valve, and means for controlling said position of said valve by fluid pressure and/or vacuum or electronically.

11. A free-piston two stroke cycle engine according to claim 8 further comprising a pressure channel for accommodating a movable fluid under pressure or vacuum and connecting said intake/transfer gate assembly of one said power cylinder and said injector gate assembly of the other said power cylinder.

12. A free-piston two stroke cycle engine comprising a piston rod assembly including a connecting rod having first and second ends, first and second power pistons mounted on said first and second ends, respectively, and first and second power transfer pistons mounted on said rod at locations spaced from each other and from said power pistons, and first and second power cylinders having first and second sealed cavities containing said first and second power pistons, respectively, said first and second power pistons being reciprocatable in said first and second cavities, respectively, between relative tops and relative bottoms, such that as either said power piston moves from its relative top toward its relative bottom the other said power piston moves from its relative bottom toward its relative top, the portions of said first and second cavities between said power pistons providing first and second precompression chambers, respectively, and the portions of said first and second cavities on opposite sides of said power pistons providing first and second combustion chambers, respectively, a timing module between said power cylinders, and first and second power transfer modules between said timing module and said first power cylinder and between said timing module and said second power cylinder, respectively, said connecting rod passing through said timing module and said power transfer modules, said first and second power transfer modules including first and second power transfer cylinders, respectively, in which said first and second power transfer pistons reciprocate, respectively.

13. A free-piston two stroke cycle engine according to claim 12 wherein the axial ends of said power pistons remote from each other are provided by convex surfaces and said sealed cavities have concave axial ends confronting said convex surfaces of said power pistons.

14. A free-piston two stroke cycle engine according to claim 13 wherein the radius of curvature of each said convex surface is the same as the radius of curvature of each said concave axial end.

15. A free-piston two stroke cycle engine according to claim 14 wherein each said power piston is provided with first and second piston rings spaced a first small axial distance from each other and adjacent the axial end thereof having said convex surface and a third piston ring spaced a second axial distance from said first and second rings, said second axial distance being substantially greater than said first axial distance.

16. A free-piston two stroke cycle engine according to claim 12 wherein said power cylinders are modular and said engine further comprises means for releasably clamping said timing module, said first power transfer module and said power cylinders together.

17. A free-piston two stroke cycle engine according to claim 16 further comprising a pair of head caps engaging said power cylinders on opposite ends thereof, wherein said clamping means include a pair of hold down bars each having a pair of holes therethrough and engaging said head caps, a pair of hold down rods each having a pair of externally threaded ends, said externally threaded ends of each said hold down rod extending through a said hole of one said hold down bar and a said hole of the other said hold down bar, and said nuts being turned into threaded engagement with said externally threaded ends, thus to clamp said timing module, said first power transfer module and said power cylinders together.

18. A free-piston two stroke cycle engine according to claim 12 further comprising first and second accumulator means associated with said first and second power cylinders, respectively, for receiving and accumulating a precompressed fuel mixture.

19. A free-piston two stroke cycle engine according to claim 18 wherein said first and second accumulator means are provided by transfer tubes each connected at one end to its associated said precompression chamber and at the other end to its associated said combustion chamber.

20. A free-piston two stroke cycle engine according to claim 19 wherein each said accumulator means is provided by a pair of said transfer tubes.

21. A free-piston two stroke cycle engine according to claim 19 further comprising an injector gate associated with each said transfer tube at the end thereof connected to its associated said combustion chamber and actuated by partial vacuums and pressures within its said associated combustion chamber and the opposing said precompression chamber.

22. A free-piston two stroke cycle engine according to claim 21 wherein said injector gates open to admit the pressurized fuel mixture in each said transfer tube into its associated combustion chamber at a desired time which is a function of the location of the piston rod assembly.

23. A free-piston two stroke cycle engine according to claim 12 wherein said power transfer pistons are of magnetic material and said first power transfer module is provided with a wire coil surrounding said first power transfer cylinder, said first power transfer piston and said wire coil acting in concert to start said engine and to generate electric current while said engine is running.

24. A free-piston two stroke cycle engine according to claim 12 further comprising a computer for determining the position and velocity of said piston rod assembly and a servo motor controlled by said computer to adjust power extraction from said piston rod assembly as it moves from one extreme to the other and to adjust the fuel mixture and/or pressures to maximize fuel economy and performance.

25. A free-piston two stroke cycle engine according to claim 12 wherein said first power transfer cylinder includes at one axial end a first fluid input valve and a first fluid output valve and at the other axial end a second fluid input valve and a second fluid output valve, the operation of said fluid input and output valves being controlled by the reciprocating motion of said first power transfer piston in said first power transfer cylinder, whereby said engine is usable to pump hydraulic fluid into and out of said first power transfer cylinder.

* * * * *

UNITED STATES PATENT AND TRADEMARK OFFICE

CERTIFICATE OF CORRECTION

PATENT NO. : 4,876,991

DATED : October 31, 1989

INVENTOR(S) : Kenneth A. Galitello, Jr.

It is certified that error appears in the above-identified patent and that said Letters Patent is hereby corrected as shown below:

IN THE ABSTRACT

Line 13 delete "are" substitute -- located --;

Column 6, line 25 after continues insert -- as the --;
Column 6, Line 52 after which insert
-- allow two stroke --.

Column 13, lines 30, 31 and 32 delete "Power transfer pistons 34 are at the left most ends of their travel in the cylinders of power transfer modules 33."

IN THE CLAIMS:

Claim 2, column 18, line 10 delete "said rod has a longitudinal center and".

Claim 11, column 20, line 3 after cylinder insert -- to the precompression side of the other said power cylinder. -- delete "and said injector gate assembly of the other said power cylinder."

Claim 20, column 21, line 17 delete "by a pair of said transfer tubes"; substitute -- by said transfer tubes --.

Claim 24, column 22, line 14 delete "and a servo motor controlled by said computer"

UNITED STATES PATENT AND TRADEMARK OFFICE

CERTIFICATE OF CORRECTION

PATENT NO. : 4,876,991

DATED : October 31, 1989

INVENTOR(S) : Kenneth A. Galitello, Jr.

It is certified that error appears in the above-identified patent and that said Letters Patent is hereby corrected as shown below:

Column 5, line 43 insert a separation line -- _____ -- between paragraphs extending across column 5.

Column 8, line 3 insert paragraph -- It is yet a further important object of the invention to provide a free piston two stroke cycle engine that is of light weight. --

Col. 9, line 26, delete the comma and insert a period after piston rod assembly --.-- Start a new sentence, delete the lower case "t" and substitute a capitol --T--. As corrected, it now reads: moving the piston rod assembly. The piston is not moved.

Column 14, line 16 insert a comma after starting -- , -- insert the word -- and -- after Mechanical Movement. As corrected, it now reads: Starting, Mechanical Movement and Engine Dynamics.

Signed and Sealed this

Seventh Day of May, 1991

*Attest:*

*Attesting Officer*

HARRY F. MANBECK, JR.

*Commissioner of Patents and Trademarks*